US010029167B2

(12) United States Patent
McGuffie et al.

(10) Patent No.: US 10,029,167 B2
(45) Date of Patent: Jul. 24, 2018

(54) LINE MARKING APPARATUS, SYSTEM AND METHOD

(71) Applicant: FLEET (LINE MARKERS) LTD, Malvern (GB)

(72) Inventors: Iain Peter McGuffie, Bromyard (GB); Jeremy Nicholls, Clitheroe (GB); Liam Darren Philpotts, Leominster (GB); James Phillip Ballard, Malvern (GB); Richard John Davis, Malvern (GB); Stewart Nathan Ridgley Swatton, Malvern (GB); Kevin James Palmer, Malvern (GB); Antony Willem Walker, Malvern (GB)

(73) Assignee: FLEET (LINE MARKERS) LTD, Malvern (GB)

( * ) Notice: Subject to any disclaimer, the term of this patent is extended or adjusted under 35 U.S.C. 154(b) by 101 days.

(21) Appl. No.: 15/168,280

(22) Filed: May 31, 2016

(65) Prior Publication Data

US 2016/0354675 A1 Dec. 8, 2016

Related U.S. Application Data

(63) Continuation of application No. 13/998,142, filed on Oct. 7, 2013, now abandoned, which is a continuation-in-part of application No. 11/658,975, filed on Dec. 10, 2008, now abandoned, which is a continuation of application No. PCT/GB2005/003093, filed on Aug. 5, 2005.

(51) Int. Cl.
*E01C 23/00* (2006.01)
*A63C 19/06* (2006.01)
(Continued)

(52) U.S. Cl.
CPC ..... *A63C 19/065* (2013.01); *E01C 23/163* (2013.01); *E01C 23/20* (2013.01); *A63C 2019/067* (2013.01)

(58) Field of Classification Search
CPC . A63C 19/065; A63C 2019/067; E01C 23/20; E01C 23/163
(Continued)

(56) References Cited

U.S. PATENT DOCUMENTS 2,691,923 A * 10/1954 Huck ..... E01C 23/166 222/512
5,054,959 A * 10/1991 Wilson ..... E01C 23/163 239/150
(Continued)

FOREIGN PATENT DOCUMENTS

DE 3703366 A1 8/1988
DE 40 13 950 A1 11/1991
(Continued)

*Primary Examiner* — Raymond W Addie
(74) *Attorney, Agent, or Firm* — MU P.C.

(57) ABSTRACT

A line marking apparatus, for use in a system that includes a source of a narrow beam of radiation which extends substantially horizontally along or parallel to a line to be marked, includes a wheeled chassis and a line marking head for dispensing line marking material. The marking head is supported on the chassis for lateral movement relative thereto, which movement is controlled by a controller that includes a detector which is movable with the marking head and is positioned and directed to detect such a beam of radiation, the marking head being movable together with the detector in response to a detected beam. Lateral movement of the marking head is thereby controlled such that the head and the detector substantially follow the line to be marked irrespective of whether the chassis deviates from the line direction.

22 Claims, 3 Drawing Sheets

(51) Int. Cl.
*E01C 23/20* (2006.01)
*E01C 23/16* (2006.01)

(58) Field of Classification Search
USPC ..... 404/84.05, 84.5, 75, 94, 111
See application file for complete search history.

(56) References Cited

U.S. PATENT DOCUMENTS

| | | | | |
|---|---|---|---|---|
| 5,169,262 | A * | 12/1992 | Wilson | E01C 23/163 404/84.05 |
| 5,203,923 | A * | 4/1993 | Hartman | B05B 9/06 118/323 |
| 5,302,207 | A * | 4/1994 | Jurcisin | E01C 23/22 118/207 |
| 6,299,934 | B1 | 10/2001 | Manning | |
| 6,951,375 | B2 | 10/2005 | Patton et al. | |
| 7,372,247 | B1 * | 5/2008 | Giusti | G01V 15/00 324/326 |
| 2015/0330039 | A1 * | 11/2015 | Vanneman | E01C 23/163 404/94 |

FOREIGN PATENT DOCUMENTS

| | | | |
|---|---|---|---|
| EP | 1 022 541 | A1 | 7/2000 |
| FR | 2541853 | A1 | 8/1988 |
| GB | 2 357 105 | A | 6/2001 |
| GB | 2 386 969 | A | 10/2003 |
| JP | 10-160486 | | 6/1998 |
| WO | 84/02150 | A1 | 6/1984 |

* cited by examiner

LINE MARKING APPARATUS, SYSTEM AND METHOD

CROSS-REFERENCE TO RELATED APPLICATIONS

This application is a continuation-in-part of U.S. application Ser. No. 11/658,975 filed Feb. 10, 2008 in respect of International application No-PCT/GB05/003093 filed 5 Aug. 2005 and claiming priority from U.K. patent application No. 0417517.0 filed Aug. 6, 2004.

BACKGROUND OF THE INVENTION

Field of the Invention

This invention relates to line marking apparatus, to a line marking system, and to a method of marking a line. The invention may be used, for example, for marking lines on sports fields and the like.

Description of Related Art

Line marking apparatus for sports fields is well known and generally comprises a line marking head and a reservoir of line marking material Mounted on a chassis provided with wheels. The line marking apparatus may be pushed by a user or may be self-powered with a seat and steering means for a user riding on the apparatus.

Although the user can steer the apparatus and guide the line marking head along a generally straight line, it is not possible for the user, for example when marking the edge of a football pitch, to maintain a substantially straight line over any significant distance and small lateral deviations are inevitable. It is therefore desirable to provide a line marking apparatus which is capable of marking a straight line even if the user diverges from such line.

Lines are generally marked either by following a string which defines an edge of the line to be marked (known as "stringing-out") or by overmarking an existing line. Both stringing-out and overmarking require considerable skill on behalf of the user to produce a straight line. In general, the faster the marking speed, the less straight will be the resulting line. To produce a particularly straight line, a skilled user is required to mark both carefully and slowly. It would clearly be advantageous to be able to mark a straight line relatively quickly.

One of the straightness problems associated with stringing-out results from the possibility that the string may move while the line is being marked. This may be due, for example, to the machine or the user touching the string, by the string becoming lodged in grass or the like, or even the effect of wind or the impact of the spray paint with which the line is being marked.

Stringing-out can also give rise to spurious paint marks on the surface being marked out. After a line has been marked, the string is generally covered with wet paint. If the line is then moved to mark a further line, any contact of the wet paint on the string with the surface being marked will give rise to spurious paint marks on the surface being marked out. It would be advantageous to be able to eliminate spurious paint marks.

It is known from DE-A-4 013 950 to use a laser beam to guide a vehicle, such as a line marking apparatus, along a straight line by adjusting the steering of the apparatus. Such a system is relatively complex in that it is necessary to adjust the position of the entire vehicle in order to adjust the position of the line marking head. That is, it is necessary to move the entire vehicle which is relatively heavy, rather than only part of the vehicle, and it is necessary to provide a mechanism which controls the steering of the vehicle. Such a system would therefore require to be modified significantly in order to be fitted to different types of line marking apparatus.

OBJECT OF THE INVENTION

It is therefore an object of the present invention to provide a line marking apparatus, line marking system and a method of marking a line which overcome or at least ameliorate the disadvantages set forth above.

SUMMARY OF THE INVENTION

According to one aspect of the present invention there is provided a line marking apparatus for use in a system that includes a source of a narrow beam of radiation which extends substantially horizontally along or parallel to a line to be marked, comprising:

- a chassis provided with wheels and with means for Propelling the apparatus along a line to be marked;
- a line marking head adapted to dispense line marking material so as to mark the line to be marked;
- means supporting the line marking head such that the line marking head is movable relative to the chassis laterally on the line marking apparatus; and
- means for controlling lateral movement of the line marking head and including a detector, movable with the line marking head laterally on the line marking apparatus, and positioned and directed to detect a beam of electromagnetic radiation which extends substantially horizontally along or parallel to the line to be marked, and control means for moving the line marking head with the detector in response to detection of the beam by the detector, whereby lateral movement of the line marking head with the detector relative to the chassis is controlled such that the line marking head and the detector substantially follow the line to be marked irrespective of whether the chassis deviates from the direction of such line.

According to another aspect of the present invention there is provided a line marking system comprising line marking apparatus and a source of a narrow beam of electromagnetic radiation which extends along or parallel to a line to be marked, the line marking apparatus comprising:

- a chassis provided with wheels and with means for Propelling the apparatus along a line to be marked;
- a line marking head adapted to dispense line marking material so as to mark the line to be marked;
- means supporting the line marking head such that the line marking head is movable relative to the chassis laterally on the line marking apparatus; and
- means for controlling lateral movement of the line marking head and including a detector, movable with the line marking head laterally on the line marking apparatus, and positioned and directed to detect a beam of electromagnetic radiation which extends Substantially horizontally along or parallel to the line to be marked, and control means for moving the line marking head with the detector in response to detection of the beam by the detector, whereby lateral movement of the line marking head with the detector relative to the chassis is controlled such that the line marking head and the detector substantially follow the line to be marked irrespective of whether the chassis deviates from the direction of such line.

According to a further aspect of the present invention there is provided a method of marking a line comprising:

providing a source of a narrow beam of electromagnetic radiation and arranging the source such that the beam extends along or parallel to a line to be marked;

providing a line marking apparatus comprising:

a chassis provided with wheels and with means for propelling the apparatus along a line to be marked;

a line marking head adapted to dispense line marking material so as to mark the line to be marked;

means supporting the line marking head such that the line marking head is movable relative to the chassis laterally on the line marking apparatus; and means for controlling lateral movement of the line marking head and including a detector, movable with the line marking head laterally on the line marking apparatus, and positioned and directed to detect a beam of electromagnetic radiation which extends substantially horizontally along or parallel to the line to be marked, and control means for moving the line marking head with the detector in response to detection of the beam by the detector;

positioning the line marking apparatus on or adjacent to the line to be marked;

moving the line marking apparatus along the line to be marked so as to mark the line, whereby lateral movement of the line marking head with the detector relative to the chassis is controlled such that the line marking head and the detector substantially follow the line to be marked irrespective of whether the chassis deviates from the direction of such line.

The apparatus may include a handle to facilitate pushing of the apparatus by a user. Alternatively, the apparatus may include a motor for propelling the apparatus and a seat for the user.

The supporting means may comprise an elongate housing incorporating means for moving the line marking head laterally relative to the chassis. Line marking head support means may extend from the elongate housing in a direction substantially parallel to the line to be marked. Alternatively, an actuator shaft may extend laterally from the elongate housing with the line marking head extending from the actuator shaft in a direction substantially parallel to the line to be marked.

The apparatus may include means for indicating when the beam of electromagnetic radiation is being detected by the detector. Such indicating means may comprise visual, audible and/or tactile means. Alternatively or additionally, the apparatus may include means for warning when the line marking head is approaching the limit of its lateral movement. Such warning means may comprise visual, audible and/or tactile means.

The apparatus may include means for inhibiting the marking of a line in the event the beam of electromagnetic radiation is not being detected by the detector.

The line marking head may be mounted pivotably such that the head can move upwardly and downwardly to compensate for any unevenness in the surface being marked.

The line marking head may be mounted so as to extend from the chassis substantially in the direction parallel to the line to be marked. Alternatively, the line marking head may be mounted laterally of the chassis.

The detector may be provided with a shield for shielding the detector from unwanted electromagnetic radiation.

The detector may be offset laterally relative to the line marking head.

The detector may be mounted substantially in an upright plane passing through dispensing means of the line marking head. The detector may be mounted adjacent to the dispensing means of the line marking head.

The detector may include a plurality of sensors. The sensors may be spaced apart by a distance similar to the intended width of the beam of electromagnetic radiation. Alternatively or additionally, the sensors may have differing spacings therebetween. The sensors may have differing gains and/or differing sizes. For example, the relative gains may increase from the innermost sensor(s) to the outermost sensors. A plurality of rows of sensors may be provided.

BRIEF DESCRIPTION OF THE DRAWINGS

For a better understanding of the present invention and to show more clearly how it may be carried into effect reference will now be made, by way of example, to the accompanying drawings in which.

DESCRIPTION OF PREFERRED EMBODIMENTS

Figure 1:
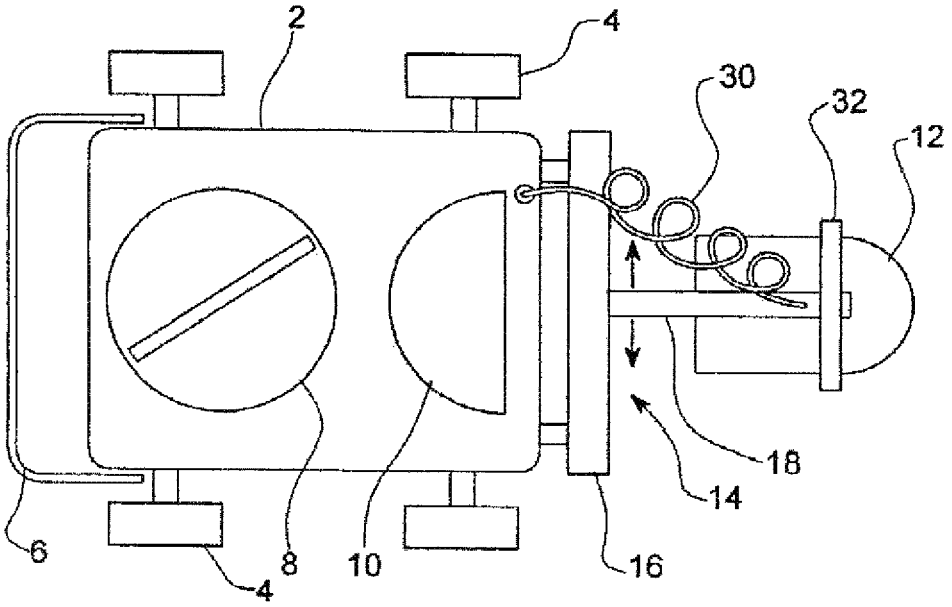
FIG. 1 is a schematic plan view of one embodiment of a line marking apparatus according to the present invention.
Figure 2:
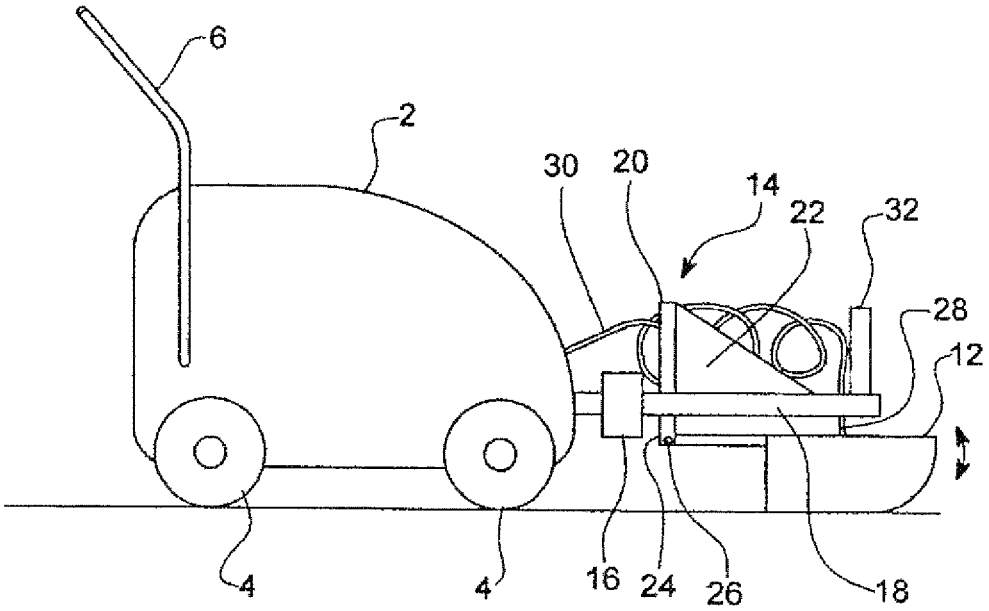
FIG. 2 is a schematic side elevational view of the line marking apparatus shown in FIG. 1.

The figures show a line marking apparatus which comprises a body 2, which forms a chassis, provided with four wheels 4 and a handle 6 to enable a user to propel the apparatus. The body 2 is also provided with a reservoir for line marking material, accessed by way of a removable closure 8, and with control equipment, accessed by way of a removable closure 10, for supplying the line marking material to a line marking head 12. Alternatively, a reservoir need not be provided in the body 2 and line marking material, such as one or more tapes, may be dispensed from the line marking head. Line marking apparatus incorporating such components is well known and requires no further explanation.

Interposed between the line marking head 12 and the body 2 is a lateral adjustment device 14. The lateral adjustment device 14 is securely fastened to the body 2, for example in the region of opposite front corners of the body and includes an elongate housing 16 incorporating a servo-motor (not shown) or other moving means provided within one end thereof, which servo-motor, by way of a belt, chain or worm drive for example, is adapted to move a supporting bar 18 laterally from side-to-side in response to signals from control equipment provided in the body 2. The supporting bar 18 extends forwardly from the body 2 generally in the direction of a line to be marked by the apparatus. Although the elongate housing is shown as being mounted forwardly of the body 2, other configurations are possible, such as the elongate housing being mounted beneath the body 2.

As an alternative to the supporting bar extending directly forwardly of the elongate housing, an actuator shaft may extend laterally from the elongate housing and may be operated, for example, by hydraulic means, a rack and pinion assembly operated by an electric motor, a lead-screw arrangement incorporating a rotatable threaded rod and the line marking head 12 mounted on a body threaded onto the rod, or a simple mechanical linkage such as a Parallelogram linkage. The supporting bar then extends forwardly from the free end of the actuator shaft. Such a configuration eliminates the need for an elongate slot in the forward face of the elongate housing which could be susceptible to the ingress of water, debris or the like. The actuator shaft can readily be sealed to the housing by way of an annular seal of elastomeric material which may expand and contract as the actuator shaft moves or which allows the actuator shaft to move relative to the seal.

In order to minimise upward and downward flexing of the supporting bar 18 an upright post 20 is provided a short distance from the elongate housing 16 and a reinforcing flange 22, of generally triangular configuration, is secured to both the supporting bar 18 and to the upright post 20, for example by welding.

A line marking head support 24 extends downwardly from the supporting bar 18 a short distance from the elongate housing 16 and the line marking head 12 is mounted on the support 24 by way of a pivot 26. A supply pipe 28 for the line marking material extends upwardly from the line marking head 12 and passes through an aperture formed in the supporting bar 18 in a manner which permits upward and downward movement of the line marking head relative to the supporting bar so as to enable the line marking head to compensate for unevenness of the ground over which the apparatus passes. The supply pipe 28 is connected to the body 2 by way of a flexible hose 30 and thence to the reservoir by conventional means (not shown).

Mounted on the supporting bar 18 is a detector 32. The detector 32 is electrically connected to control equipment provided within the body 2 for controlling lateral movement of the supporting bar 18 and consequently the line marking head 12. The detector 32 is mounted so as to be substantially in the same vertical plane as a line marking material dispenser, such as a spray nozzle, forming part of the line marking head, or at least in a plane which is close to the line marking material dispenser. In practice the detector 32 is generally positioned immediately in front of the spray nozzle of the line Marking head 12. This has been found to be important in order to minimise any yaw effects which can otherwise arise if the line marking head and the detector are separated by a substantial distance in the direction of the line to be marked. Similarly, it is desirable for the elongate housing to be as close to the body as possible because the forward Protrusion of the supporting bar 18 gives rise to an exaggerated lateral movement of the supporting bar as compared with the front of the body 2.

The lateral adjustment device, including the line marking head 12, may be removable from the body 2 to facilitate transportation and/or storage of the line marking apparatus.

Figure 4:
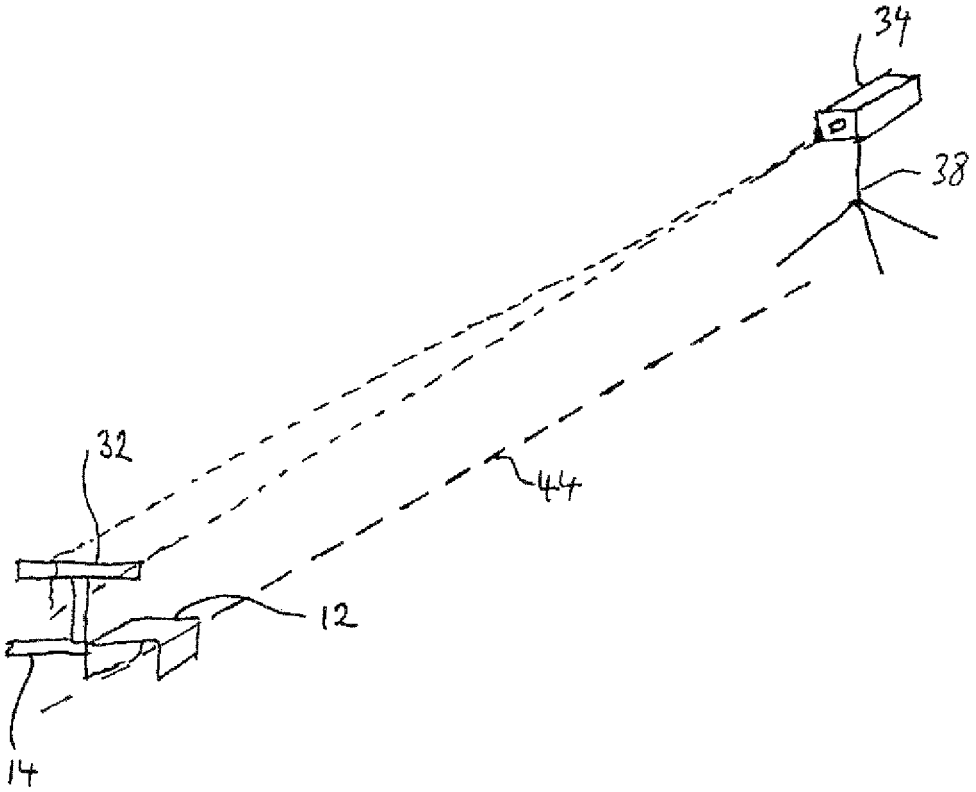
FIG. 4 is a schematic illustration of part of a line marking system according to the present invention.
Figure 5:
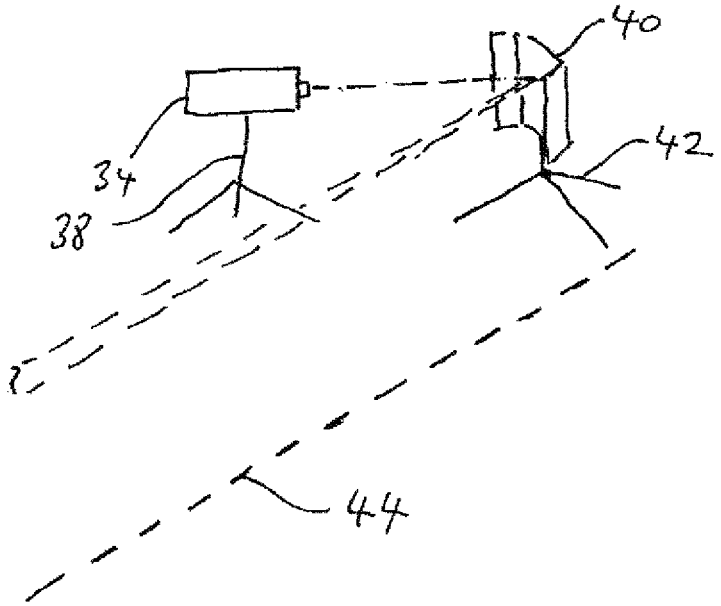
FIG. 5 is a modification of the line marking system shown in FIG. 4.

The detector 32 is adapted to be sensitive to a narrow beam of electromagnetic radiation, for example a beam of laser energy, which extends along or parallel to the line to be marked. One such arrangement is shown in FIG. 4, while a modification is shown in FIG. 5. FIG. 4 shows part of a line marking apparatus, including a line marking head 12, a lateral adjustment device 14 and a detector 32 and a source 34 of a narrow beam of electromagnetic radiation in the form of a laser emitting a narrow beam which is vertically fanned and which extends along the direction (i.e., along or parallel to) of the line to be marked 36. In practice, the line marking head is to one side of the detector and the beam is therefore parallel to the line 44 to be marked. The laser 34 is mounted on a support 38, for example in the form of a tripod. FIG. 5 shows a modification of part of FIG. 4 in which a reflector 40 is positioned to reflect the electromagnetic (laser) energy in the direction (i.e., along or parallel to) of the line to be marked, while the source 34 emits the radiation towards the reflector 40. The reflector 40 is mounted on a support 42, for example in the form of a tripod.

Such a laser beam may be intensity modulated in order that the detector sensitivity can be tuned only to detect radiation modulated at the modulation frequency in order to eliminate interference due to incident radiation, such as sunlight. Alternatively, pulse width modulation may be employed, which could be advantageous if communication between the source and the line marking apparatus is required. As noted above, ideally, the beam of electromagnetic radiation is vertically fanned, for example in the range 1 to 2 degrees, to accommodate upward and downward movement of the detector due to undulations in the ground surface. The beam of electromagnetic radiation may have a varying lateral intensity profile, for example resembling a Gaussian distribution, rather than an abrupt edge. Where a reflector is employed it is possible to provide a plurality of reflectors over the area to be marked in order to define a plurality of lines to be marked. In this respect, the use of a penta-prism in conjunction with a laser source allows two lines to be marked at right angles to each other without re-positioning the source of electromagnetic radiation. Other splitting prisms are available which generate three or four separate beams, for example at 90 degree spacing. If desired, the detector 32 may be adjustable upwardly and downwardly to compensate to the degree of irregularity in the surface to be marked. In order to minimise any effects of stray electromagnetic radiation, the detector may be provided with a shield which limits the ingress of stray radiation without diminishing the response of the detector to direct radiation from the source. Alternatively or additionally, the beam of electromagnetic radiation may be modulated in a predetermined manner and the detector may be adapted to recognise only radiation having the predetermined modulation. As a further alternative, the detector may incorporate a narrow-pass filter which is adapted to pass substantially only the wavelength of emitted by the source of electromagnetic radiation. If reflectors are used, these are preferably in the form of a narrow strip of highly reflective material mounted upright on a base plate. Side plates may be provided to shield the reflective material from sunlight.

The detector 32 tracks the beam of electromagnetic radiation and causes, by way of control equipment provided in the body 2, the supporting bar 18 to move laterally either left or right to maintain the supporting bar substantially in line with or parallel to the beam of electromagnetic radiation. Thus, if the user should inadvertently steer the apparatus to the left of the intended line to be marked, the detector 32 will cause the supporting bar 18 to move to the right by an appropriate amount to maintain the supporting bar, and therefore the line marking head 12, substantially in line with or parallel to the beam of electromagnetic radiation and consequently along the line to be marked. Similarly, if the user should inadvertently steer the apparatus to the right of the intended line to be marked, the detector 32 will cause the supporting bar 18 to move to the left by an appropriate amount to maintain the supporting bar, and therefore the line marking head 12, substantially in line or parallel with the beam of electromagnetic radiation and consequently along the line to be marked. Lateral movement of the supporting bar 18 in the elongate housing 16 therefore compensates for any errors made by the user (within the bounds of the elongate housing) and maintains a straight line irrespective of any such errors.

The detector 32 incorporates a plurality of sensors which are sufficient in number (i.e., at least two) and spaced a sufficient distance apart such that the distance separating the sensors is similar to the width of the beam of electromagnetic radiation when the source is relatively close to the detector 32. In this way the beam of electromagnetic radiation does not fall wholly between adjacent sensors, but rather at least one of the sensors will receive electromagnetic radiation of substantially different intensity to at least one of the other sensors when the source is at a substantial distance from the detector 32 and the width of the beam may have increased somewhat. The spacing between the sensors enables the control equipment to determine the location of the detector relative to the axis of the beam and consequently to establish the amount and direction of any movement of the supporting bar 18 that may be necessary to maintain the supporting bar in line or parallel with the axis of the beam of electromagnetic radiation. If desired, the sensors may be arranged in more than one, for example two, laterally extending rows. The use of more than one row of sensors allows the control equipment to determine whether the detector is substantially in a horizontal plane or whether it, and therefore the line marking apparatus, is tilted, for example as a result of marking a line on an uneven surface. Any such tilting could affect the relative position of the line being marked and can be compensated for by the control equipment moving the line marking head appropriately in order to maintain a straight line.

While the beam of electromagnetic radiation will ideally be parallel this cannot in practice be achieved and a small degree of divergence is inevitable. It has been found that a lateral array of at least three, and ideally at least four, sensors spaced a few millimeters apart allows the detector to function effectively with a wide range of widths of the beam of electromagnetic radiation. The precise spacing of the sensors can readily be determined by experiment and requires no inventive contribution.

Moreover, it is advantageous if the sensors have different gains. In this respect, in the case of four sensors arranged in a lateral array the two inner sensors may have a first gain and the two outer sensors may have a second gain, the second gain being higher than the first gain. Ideally the gain of the two outer sensors is several times the gain of the two inner sensors. If further sensors are provided in the lateral array, the relative gains should increase from the innermost sensor(s) to the outermost sensors. In this way the further the detector 32 is out of alignment with the beam of electromagnetic radiation the greater is the feedback signal tending to move the supporting bar 18 relative to the elongate housing 16 in order to align the detector 32 with the axis of the beam of electromagnetic radiation.

Additionally or alternatively, the dimensions of the sensors may differ. Thus, the inner sensors may be relatively small and the outer sensors may be relatively large. For example, the inner sensors may comprise photodiodes of about 0.1 $mm^2$ of relatively low sensitivity and spaced about 3 mm apart, while the outer sensors may comprise photodiodes of about 7 $mm^2$ of relatively high sensitivity spaced about 40 mm apart. As explained hereinabove, the precise spacings of the sensors will depend on the nature of the beam of electromagnetic radiation emitted by the source and may require to be adapted. Where the beam of electromagnetic radiation has a varying lateral intensity profile, the sensors can use the varying intensity to generate a constantly varying feedback signal to the means for moving the supporting bar 18 to control the position thereof. In this way, the inner sensors respond more effectively when the line marking apparatus is relatively close to the source of electromagnetic radiation, while the outer sensors respond more effectively when the lire marking apparatus is relatively far from the source of electromagnetic radiation.

The lateral adjustment device 14 may be adapted such that line marking may be carried out both towards and away from the source of electromagnetic radiation. For example, the detector sensors may be mounted in a transparent housing or the detector 32 may be mounted in a manner which permits it to be moved through 180 degrees when the marking direction is changed.

The control equipment in the body 2 may be adapted to respond to a situation in which the beam of electromagnetic radiation is not being detected by the detector 32. If the beam of electromagnetic radiation is not being detected the control equipment may be adapted to discontinue the feed of line marking material r e the line marking head 12 in order that a line should not be marked in an incorrect location in the event, for example, that the beam of electromagnetic radiation should be obstructed or that the apparatus is moved by the user a sufficient distance away from the intended line that movement of the supporting bar 18 in the elongate housing 16 is unable to compensate. If desired, feed of the line marking material may only be discontinued if the beam of electromagnetic radiation is not detected for a predetermined time, such as 100 milliseconds. The incorporation of a delay reduces the risk of spurious interruptions such as may be caused by a person or an animal passing the beam, while ensuring that the line being marked does not visibly deviate from the desired line.

In order to eliminate as far as possible the possibility that movement of the supporting bar 18 may be unable to compensate, the line marking apparatus may be provided with a visual, audible and/or tactile warning means which warns the user when the supporting bar 18 is approaching its maximum extent of movement within the elongate housing 16. For example, visual warning means in the form of a row of light emitting diodes may be provided to indicate the relative position of the head relative to the supporting bar. The light emitting diodes may be of different colours, for example with green LEDs in the region of the centre of the warning means, red LEDs at the end regions of the warning means and orange LEDs intermediate the green and red LEDs. Such an arrangement conveys to the operator the relative urgency of taking corrective action. Similarly, the line marking apparatus may be provided with visual, audible and/or tactile means to indicate to the user that the detector 32 is receiving the beam of electromagnetic radiation.

In use of the line marking apparatus, the apparatus may be set up for marking a line in a number of different ways. For example, a telescopic sighting means may be provided on the source of electromagnetic radiation and directed at the line marking apparatus or other target, either or both of which may be provided with a reflective element. The target may be provided with indicating means, for example visual, audible or adapted to transmit a signal, to indicate to the user that the source is correctly aimed.

Alternatively, the source may be provided with a target-seeking system. In such a case, the target-seeking system will cause the source to rotate until it receives information that the source is correctly aimed. The source is then locked in position. Such a target-seeking system may include a detector mounted on the source and which is responsive to radiation reflected back from the target or a detector mounted on the target and which transmits a signal back to the target-seeking system by suitable means, such as radio, infra-red or ultrasonic means. The signal may be either analog or digital.

The target-seeking system may be controlled from the source, from the line marking apparatus or from any other convenient location.

It will be appreciated that the line marking apparatus shown in the drawings is adapted to be pushed by a user. However, the present invention is equally capable of being employed in conjunction with a self-powered, or ride-on, line marking apparatus. In contrast with controlling the steering of the line marking a apparatus, it is relatively straightforward to mount the lateral adjustment device on a variety of different line marking apparatus. Further, although the lateral adjustment device is shown mounted immediately in front of the line marking apparatus it may in certain circumstances, for example when the apparatus is a ride-on apparatus or to provide a particularly convenient configuration for maneuvering around obstacles such as goal posts or the like, be advantageous to mount the lateral adjustment device to one side of the line marking apparatus. Such an arrangement is advantageous in that it eliminates or at least minimises any deviation that may be required to maneuver around an obstacle positioned on or immediately adjacent to the line being marked. A further option is to position the detector offset relative to the line marking head by a predetermined distance and to position the source offset from the intended line by a similar distance to further improve maneuverability around obstacles. In this way the source is less likely to be obscured by an obstacle. The offset should ideally be at least half the width of any expected obstacle.

The line marking head 12 may be combined with a distance and/or position measuring device to initiate or discontinue the supply of line marking material to mark a discontinuous line or, because the line marking head 12 is movable laterally relative to the body 12, to make a mark in a lateral direction to the direction of the line being marked. For example, on a football field lateral marks could be made indicating the correct position of the centre line, goal area and the like. It would then not be necessary to make separate measurements to mark the positions of such lines.

The distance and/or position measuring device may be a tape or cord adapted to allow the user to determine the distance from a fixed point. For example, the tape or cord may be provided with distance markings, which may be visual or otherwise encoded into the tape or cord, such as by magnetic means. Alternatively, distance may be measured by determining the number of rotations of a wheel provided as part of the line marking apparatus. As a further alternative, distance may be determined in a manner well known in optical rangefinders by analysing interference patterns in a modulated beam of electromagnetic radiation.

In a more sophisticated arrangement, the supply of line, marking material may be initiated and discontinued to generate a pattern of marked and unmarked areas which can be marked side-by-side as separate lines to build up an image on the surface being marked. If desired, the line marking head may be provided with means for marking lines of different colours which can be independently initiated and discontinued to build up a coloured image on the surface being marked. Lines of relatively large width, or multiple adjacent lines can be marked where the line marking head is expanded laterally to incorporate means for marking multiple side-by-side lines.

Figure 3:
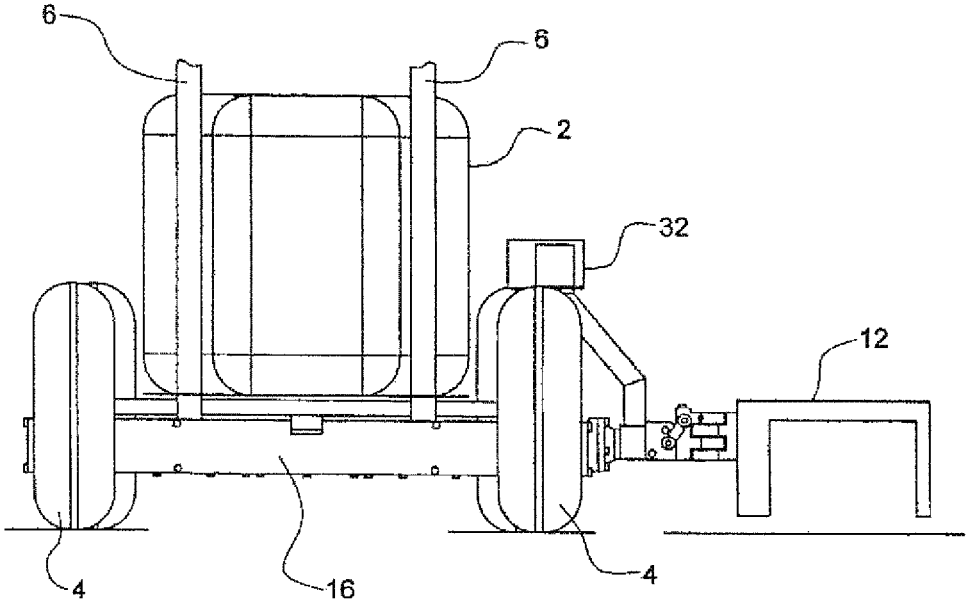
FIG. 3 is a schematic view from the rear of another embodiment of a line marking machine according to the Present invention.

As shown in FIG. 3, the line marking head 12 and the detector 32 may be offset laterally from the body 2 of the line marking apparatus. The supporting bar 18 is not required in the embodiment of FIG. 3. Such an arrangement allows the operator a better view of the line being marked and allows the operator to walk directly behind the line marking apparatus without having to straddle the line being marked in order to avoid damaging the line. Moreover, the source of electromagnetic radiation may be positioned behind the user without there being any risk of the user interrupting the beam.

Thus, the detector may be adapted to detect radiation from a source of electromagnetic radiation positioned in front of the apparatus or behind the apparatus. As a further alternative, the detector may be turned through 180 degrees so as to be adaptable to either position for the source of electromagnetic radiation. An ideal arrangement for the source of electromagnetic radiation, especially in the case where the beam is a laser beam, is behind the user so that the user is not looking towards the source of laser radiation while marking a line. Such an arrangement can also save time in that the user can set up the source of electromagnetic radiation and then mark the line while walking away from the source, rather than setting up the source at the far end of the line to be marked and subsequently having to walk the length of the line to operate the line marking apparatus.

Because it is necessary only to move the line marking head 12 to align with the beam of electromagnetic energy, there is relatively little mass to move. Consequently, any corrections can be made relatively quickly, resulting in smaller line errors and permitting an increased marking speed. It has been found that the lateral adjustment device is sufficiently responsive that the line marking apparatus can be pushed at running pace, or can travel at 15 to 25 kilometers per hour or more, while maintaining a straight line to within about 2 to 3 mm. In contrast, we have found that it is possible for an unskilled user to mark a line which is straight within ±30 mm over a distance of 120 meters without the use of any other means of guidance (such as strings or a pre-marked line). This accuracy can be achieved at a fast walking pace if using a pedestrian apparatus or at speeds in excess of 16 kilometers per hour if using a motorised apparatus. Where the user is following a pre-marked line, the line can be re-marked with even greater accuracy. Previously, this combination of speed and accuracy has not been possible even when the line is marked by a skilled user.

It has also been found that, because only the line marking head requires to be moved laterally, the line marking machine can accommodate the effects of any changes in the direction in which the blades of grass are lying. The line marking apparatus moves over and is supported by the grass, and the "lie" of the grass, that is the direction in which the blades of grass are facing, can give rise to errors in the line being marked. With conventional line marking machines, a change in the lie of the grass can cause the machine, and therefore the line marking head, to move laterally by up to 2 cm. This is an amount which is unacceptable for lines being marked on many sports fields, for example. In a traditional line marking machine, in which the line marking head is securely mounted on the chassis, any lateral movement is transferred directly to the line marking head and gives rise to an error in the line being marked. By way of contrast, in the case of the line marking apparatus according to the present invention, because the line marking head is movable independently of the body, lateral errors due to movement of the body as a result of changes in the lie of the grass are compensated for by lateral movement of the line marking head relative to the body and such errors in the line being marked do not arise.

Having thus described the invention, what is claimed is:

1. A line marking apparatus for marking a new straight line without using a guide string, for use in a system that includes a separate source of electromagnetic radiation remote from the apparatus, the apparatus comprising:

a body provided with wheels for movement in the direction of a straight line that is to be marked;

a line marking head comprising a dispensing nozzle that is constructed to dispense line marking material so as to mark the straight line that is to be marked;

a lateral adjustment device operatively supporting the line marking head on the body for effecting relative lateral movement therebetween; and control equipment operative to control the lateral adjustment device, the control equipment comprising a detector for detecting electromagnetic radiation from the said remote source, for generating a feedback signal for position control of the lateral adjustment device, whereby lateral movement of the line marking head, relative to the body, is controlled by the control equipment such that, when the apparatus is moved along or parallel to a direction of the new straight line to be marked, the dispensing nozzle moves along the new straight line that is to be marked irrespective of whether movement of the body deviates from the direction of the said new straight line.

2. The line marking apparatus of claim 1, wherein:

the electromagnetic radiation is indicative of the straight line that is to be marked and the control equipment is configured for, in automatic response to detection of such indicative electromagnetic radiation, generating a feedback signal for position control of the lateral adjustment device by the control equipment.

3. The line marking apparatus of claim 2, wherein the separate source comprises a narrow beam of electromagnetic radiation which extends substantially horizontally from the source along or parallel to the straight line to be marked, and wherein:

the detector is movable with the line marking head relative to the body laterally on the line marking apparatus, and positioned and directed to detect, when said apparatus is moved along the straight line to be marked, the narrow a beam of electromagnetic radiation, and wherein the control equipment is operative to move the line marking head, with the detector, in automatic response to detection of the beam by the detector, whereby lateral movement of the line marking head with the detector relative to the body is controlled by the control means such that the line marking head and the detector track the beam of electromagnetic radiation, in the direction along or parallel to the straight line to be marked.

4. The apparatus of claim 1, wherein the apparatus includes a handle to facilitate pushing of the apparatus by a user.

5. The apparatus of claim 1, wherein the apparatus includes a motor for propelling the apparatus and a seat for the user.

6. The apparatus of claim 1, wherein the lateral adjustment device comprises an elongate housing incorporating means for moving the line marking head laterally relative to the body.

7. The apparatus of claim 6, wherein an actuator shaft extends laterally from the elongate housing with the line marking head extending from the actuator shaft in a direction substantially parallel to the line to be marked.

8. The apparatus of claim 3, wherein the apparatus includes means for indicating when the beam of electromagnetic radiation is being detected by the detector.

9. The apparatus of claim 1, wherein the apparatus includes means for warning when the line marking head is approaching a limit of its lateral movement.

10. The apparatus of claim 3, wherein the apparatus includes means for inhibiting the marking of a line in the event a substantially horizontally extending narrow the beam of electromagnetic radiation is not being detected by the detector.

11. The apparatus of claim 1, wherein the line marking head is mounted pivotably such that the head can move upwardly and downwardly to compensate for any unevenness in a surface being marked.

12. The apparatus of claim 1, wherein the line marking head is mounted so as to extend from the body substantially in the direction parallel to the line to be marked.

13. The apparatus of claim 1, wherein the line marking head is mounted laterally of the body.

14. The apparatus of claim 1, wherein the detector is provided with a shield for shielding the detector from unwanted electromagnetic radiation.

15. The apparatus of claim 1, wherein the detector is mounted substantially in an upright plane passing through the dispensing nozzle of the line marking head.

16. The apparatus of claim 15, wherein the detector is mounted adjacent to the dispensing nozzle of the line marking head.

17. The apparatus of claim 1, wherein the detector includes a plurality of sensors.

18. The apparatus of claim 17, wherein a plurality of rows of sensors is provided.

19. A line marking system, the line marking system comprising a line marking apparatus for marking a new straight line without using a guide string, and a separate source of electromagnetic radiation, remote from the line marking apparatus, the line marking apparatus comprising:

a body provided with wheels for movement in the direction of a straight line that is to be marked;

a line marking head comprising a dispensing nozzle that is constructed to dispense line marking material so as to mark the straight line that is to be marked;

a lateral adjustment device operatively supporting the line marking head on the body for effecting relative lateral movement there between;

control equipment operative to control the lateral adjustment device, the control equipment comprising a detector for detecting electromagnetic radiation from the said remote source, for generating a feedback signal for position control of the lateral adjustment device, whereby lateral movement of the line marking head, relative to the body, is controlled by the control equipment such that, when the apparatus is moved along or parallel to a direction of the new straight line to be marked, the dispensing nozzle moves along the new straight line that is to be marked irrespective of whether movement of the body deviates from the direction of the new straight line.

20. The line-marking system of claim 19, wherein the separate remote source comprises a narrow beam of electromagnetic radiation which extends substantially horizontally from the source along or parallel to the straight line to be marked, and wherein:

the detector is movable with the line marking head relative to the body laterally on the line marking apparatus, and positioned and directed to detect, when said apparatus is moved along the straight line to be marked, the narrow beam of electromagnetic radiation, and wherein the control equipment is operative to move the line marking head, with the detector, in automatic response to detection of the beam by the detector, whereby lateral movement of the line marking head with the detector relative to the body is controlled by the control means such that the line marking head and the detector track the beam of electromagnetic radiation, in the direction along or parallel to the straight line to be marked.

21. A method of marking a new straight line without using a guide string, using a system comprising a line marking apparatus and a separate source of electromagnetic radiation, remote from the line marking apparatus, the method comprising:

providing the line marking apparatus, said apparatus comprising:

a body provided with wheels for movement in the direction of the new straight line that is to be marked;

a line marking head comprising a dispensing nozzle that is constructed to dispense line marking material so as to mark the line that is to be marked;

a lateral adjustment device operatively supporting the line marking head on the body for effecting relative lateral movement therebetween; and control equipment operative to control the lateral adjustment device, the control equipment comprising a detector for detecting electromagnetic radiation from the said remote source, for generating a feedback signal for position control of the lateral adjustment device, whereby lateral movement of the line marking head, relative to the body, is controlled by the control equipment; and moving the line marking apparatus along or parallel to the new straight line to be marked, so as to mark the new line, whereby lateral movement of the line marking head relative to the body is controlled by the control equipment such that the dispensing nozzle moves along the new straight line that is to be marked, irrespective of whether the body deviates from the direction of the new straight line.

22. The method of claim 21, wherein:

the electromagnetic radiation is provided as a narrow beam which extends substantially horizontally from the source along or parallel to the new straight line to be marked;

the detector moves with the line marking head relative to the body laterally on the line marking apparatus;

the detector is positioned and directed to detect the narrow beam of electromagnetic radiation;

the control equipment moves the line marking head, with the detector, in automatic response to detection of the beam by the detector; and the lateral movement of the line marking head with the detector relative to the body is controlled by the control means such that the line marking head and the detector track the beam of electromagnetic radiation, in the direction along or parallel to the new straight line to be marked.

* * * * *